United States Patent [19]

Neyraud

[11] Patent Number: 4,922,706

[45] Date of Patent: May 8, 1990

[54] DEVICE LIMITING BALLOONING IN THE UNWINDING OR WINDING OF A YARN

[75] Inventor: René Neyraud, Saint Cyr Au Mont D'or, France

[73] Assignee: ICBT Lyon, France

[21] Appl. No.: 363,599

[22] Filed: Jun. 7, 1989

[30] Foreign Application Priority Data

Jun. 21, 1988 [FR] France ..... 8808563

[51] Int. Cl.[5] ..... D01H 7/18; D01H 13/12

[52] U.S. Cl. ..... 57/354; 57/58.83; 57/356

[58] Field of Search ..... 57/352–357, 57/58.83, 58.86

[56] References Cited

U.S. PATENT DOCUMENTS

| | | | |
|---|---|---|---|
| 1,260,212 | 3/1918 | Kuderli | 57/356 X |
| 1,611,166 | 12/1926 | Daniloff | 57/356 X |
| 2,932,936 | 4/1960 | Landolt | 57/356 X |
| 3,077,726 | 2/1963 | Lenk | 57/356 X |
| 3,343,359 | 9/1967 | Franzen et al. | 57/356 X |
| 3,374,618 | 3/1968 | Franzen | 57/354 X |
| 3,410,074 | 11/1968 | Nimitz et al. | 57/354 |
| 3,648,449 | 3/1972 | Greive | 57/354 X |

FOREIGN PATENT DOCUMENTS 469828 4/1969 Switzerland .

*Primary Examiner*—John Petrakes
*Attorney, Agent, or Firm*—Arnold, White & Durkee

[57] ABSTRACT

An anti-ballooning can having the form of an enclosure surrounding the yarn winding over its entire height, characterized in that the enclosure has a cylindrical portion against which the ballooning yarn comes to rub over the entire height as it moves past, and which is extended by a likewise cylindrical zone which has a larger diameter and of which the end near the base of the winding is frustoconical in shape, its shorter section having a diameter slightly smaller than the diameter of the zone in contact with the balloon.

3 Claims, 2 Drawing Sheets

DEVICE LIMITING BALLOONING IN THE UNWINDING OR WINDING OF A YARN

The present invention relates to an improvement made to ballooning limiting devices (or antiballooners) used in the field of the textile industry, particularly in unwinding, throwing, twisting and like operations to which the yarn may be subjected during its manufacture, or the double-twist principle is applied in this operation.

Figure 1:
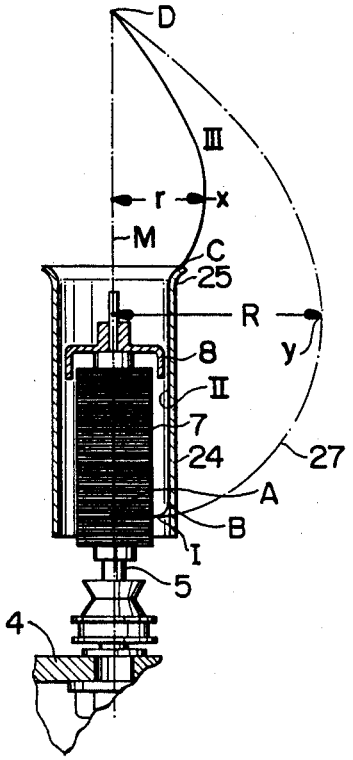
Fig. 1 PRIOR ART
Figure 2:
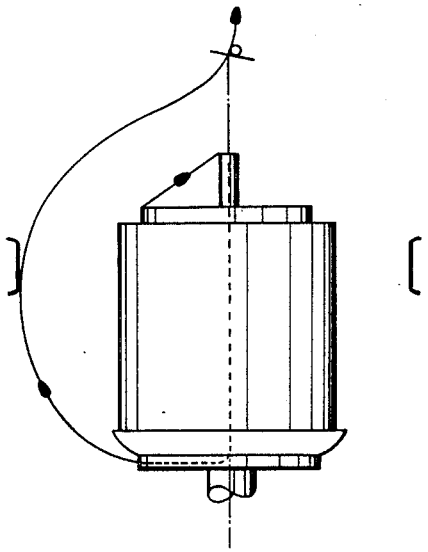

It is well known that in the throwing of textile yarns the yarn forms a balloon between the guide eye disposed in line with the spindle and the surface of the winding carried by the latter. It was proposed a long time ago (see U.S. Pat. No. 1,260,212), particularly for the purpose of increasing speed and reducing power consumption while achieving short distances between two successive spindles, to use systems which enable the balloon to be restrained. To do this, the system adopted for decades is that described in the abovementioned patent, and consists in essence of disposing a can (or sleeve) around the yarn winding, over the entire height of the latter. A solution of this kind, which is illustrated in the accompanying FIG. 1, which in turn is a reproduction of FIG. 3 of the above-mentioned United States patent, gives entire satisfaction and is used at the present time both in the case of single-twist spindles (as illustrated in FIG. 1) and in the case of double-twist spindles (as illustrated in FIG. 2). However, taking into account the fact that the yarn rubs against the entire height of the sleeve during unwinding (or winding), and particularly because of the resulting friction, it has been proposed to replace such tall sleeves by simple rings of slight height, in such a manner that the ballooning yarn rubs permanently over the entire surface and thus brings about self-cleaning. However, use is increasingly made of pneumatic systems for threading the yarn and, in the case of double-twist spindles such as that shown in FIG. 2, technicians have been obliged to revert to earlier solutions, that is to say to have antiballooning cans (as illustrated in FIG. 3) which extend over the entire height of the winding, so as to form a passage guiding the yarn during threading as far as the top of the antiballooner.

Figure 3:
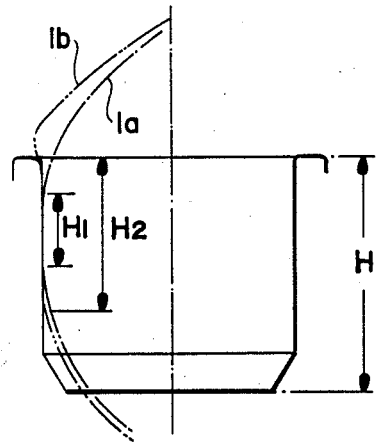

With a device of the kind illustrated in FIG. 3 it has been found that, depending on the type of yarn used, it was possible for the yarn not to be in contact over the entire height H of the antiballooning system. Thus, with one type of yarn (1*a*) the balloon will simply be in rubbing contact over a short height H1, and, when a new type of yarn (1*b*) is treated, the balloon may tend to be in rubbing contact over a height H2. In these circumstances, when the first yarn (1*a*) was treated, although self-cleaning of the entire surface in contact was achieved, nevertheless the parts below and above that surface may be soiled and entail the impairment or dirtying of the new yarn (1*b*) treated.

A new type of antiballooning can, constituting the object of the present invention, has now been found, which is of simple design and which not only enables pneumatic threading of the yarn to be achieved, but also ensures a constant and identical height of contact between the balloon and the surface of the can, whatever the type of yarn treated.

In a general way, the new type of antiballooning can according to the invention is in the form of an enclosure surrounding the yarn winding over its entire height, and it is characterized in that the enclosure comprises a cylindrical portion against which the ballooning yarn comes to rub over the entire height as it moves past, and which is extended by a likewise cylindrical zone which has a larger diameter and of which the end near the base of the winding is frustoconical in shape, its shorter section having a diameter slightly smaller than the diameter of the zone in contact with the balloon.

An antiballooner of this kind may be constructed in one piece, or optionally may comprise two parts fitting one into the other.

Figure 4:
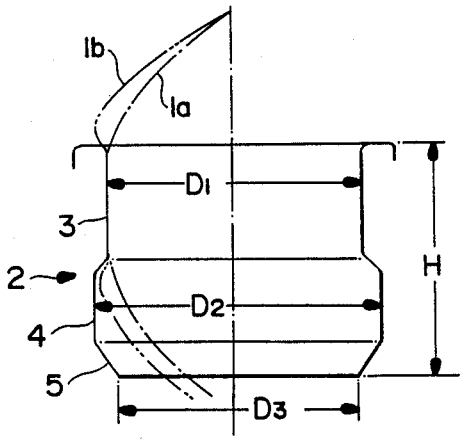
Figure 5:
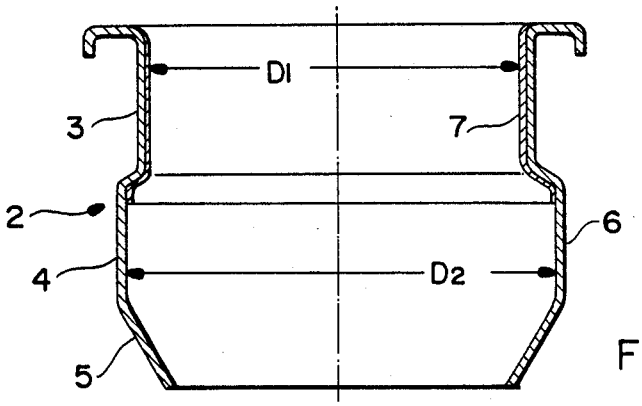

The invention and the advantages which it provides will however be better understood from the example of embodiment given below by way of indication, but without constituting a limitation, and which is illustrated in the accompanying drawings, in which:

FIGS. 1, 2 and 3 illustrate earlier solutions, as already stated, and FIGS. 4 and 5 are two sectional views showing the construction of an antiballooning can according to the invention.

In comparison with previous solutions, the antiballooning can according to the invention, which is illustrated in FIGS. 4 and 5, is thus in the form of a unit, given the general reference (2) and having a cylindrical top part (3). The total height H of the anti-ballooning system (2) is substantially equal to the height of the yarn winding. Furthermore, the height (3) of the cylindrical portion with which the ballooning yarn comes into contact is preferably equal to half the total height of the antiballooning system.

This cylindrical contact portion (3) is extended by a second cylindrical portion (4) whose diameter D2 is greater than the diameter D1 of the portion (3). Finally, the second cylindrical portion (4) is extended by a frustoconical portion (5), whose smaller diameter D3 is preferably slightly smaller than the diameter D1 of the portion in contact.

A unit of this kind may be made either in one piece of metal or, as illustrated in FIG. 5, in two pieces fitting one into the other, the outer portion (6) being produced by moulding plastic material and having a configuration comprising the three zones (3, 4, 5) of the antiballooning can according to the invention, while the contact zone (3) is lined with a metal sleeve (7). Through the use of a device of this kind the ballooning yarn will during operation be in contact over the entire height of the portion (3) of the can, whatever the nature of the yarn, the balloon being restrained as shown in FIG. 4. Thus, it can be seen in FIG. 4 that the yarn (1*a*) bears against the zone (3) over the entire height of the latter, and that the ballooning yarn (1*b*), which in the case of a circular can would tend to come to bear thereagainst over a greater height, also bears only against the zone (3).

A device of this kind, which is of a particularly simple design, is very effective and eliminates all risk of soiling and impairment of the yarn when a change of material is made, while permitting pneumatic threading.

The invention is obviously not restricted to the example of embodiment described above, but covers all variants thereof which are constructed in the same spirit.

I claim:

1. An anti-ballooning can which encloses a yarn winding over its entire height, said can comprising: 'a first cylindrical portion which contacts a ballooning yarn exceeding a periphery of said winding over an entire length of an inner surface of said first cylindrical portion;

a second cylindrical portion extending from said first cylindrical portion, said second cylindrical portion having a diameter which is larger than that of said first cylindrical portion; and a frustoconical portion extending from said second cylindrical portion, said frustoconical portion having a diameter which is smaller than that of said first cylindrical portion.

2. The antiballooning can of claim 1, wherein said can is unitary.

3. The antiballooning can of claim 1, wherein said can comprises interlocking pieces.

* * * * *